US005092283A

United States Patent [19]

Holt

[11] Patent Number: 5,092,283

[45] Date of Patent: Mar. 3, 1992

[54] METHOD AND DEVICE FOR REDUCING CORROSION IN INTERNAL COMBUSTION ENGINES

[76] Inventor: Stephen G. Holt, 853 S. 8th St., San Jose, Calif. 95112

[21] Appl. No.: 698,493

[22] Filed: Apr. 26, 1991

[51] Int. Cl.[5] ..... F02F 1/14

[52] U.S. Cl. ..... 123/41.79; 123/41.74

[58] Field of Search ..... 123/41.28, 41.74, 41.79, 123/41.80

[56] References Cited

U.S. PATENT DOCUMENTS 4,667,635 5/1987 Lichtblau ..... 123/41.8

*Primary Examiner*—Noah P. Kamen

*Attorney, Agent, or Firm*—Robert S. Smith

[57] ABSTRACT

A device and method for substantially reducing corrosion of an engine cylinder which includes a means for changing the pattern of current flow of cooling water between the wall of the cylinder and wall of cavity within the engine block. In one embodiment, the device is a metal strip, clipped into the edges of the entrance and extending into the cavity where it disrupts the flow of water along to flow in a substantially continuous circumferential direction. In this situation, the device is a bent strip of steel, having a detente for engaging the device in the entrance to the cooling cavity area and extending into the cavity where it changes the pattern of current flow. Other configurations serving the same purpose would depend on the design of the engine block.

11 Claims, 1 Drawing Sheet

FIG. 4
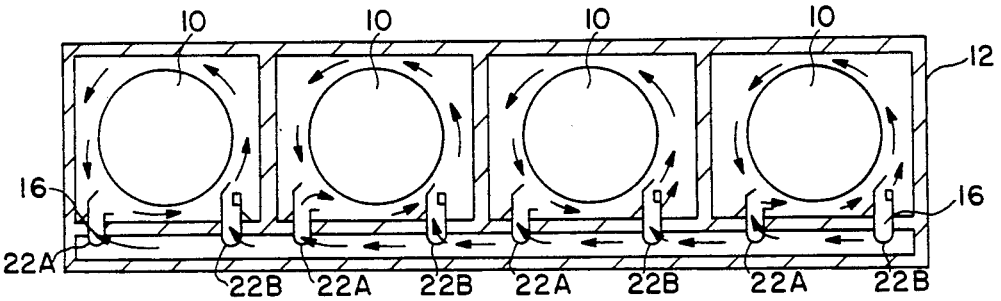
FIG. 1
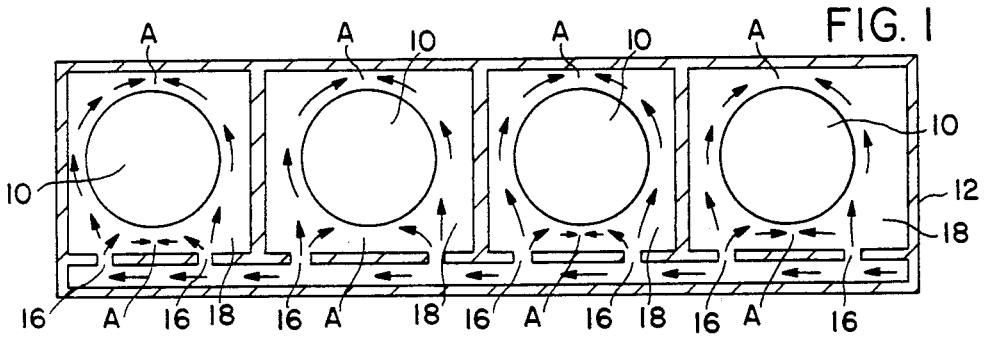
FIG. 2
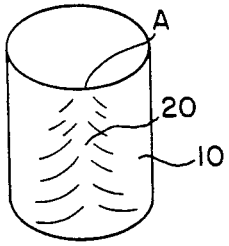
FIG. 3A
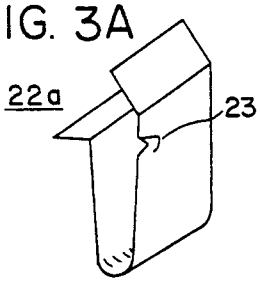
FIG. 3B
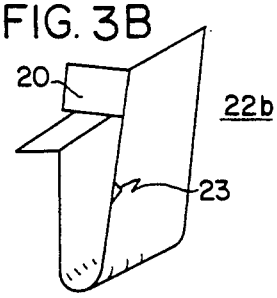
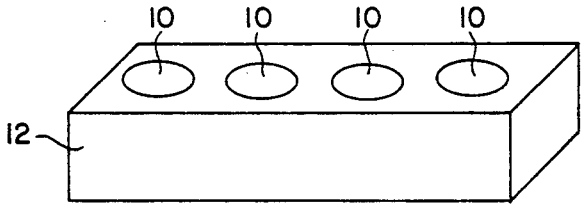
FIG. 5

METHOD AND DEVICE FOR REDUCING CORROSION IN INTERNAL COMBUSTION ENGINES

BACKGROUND

1. Field of the Invention

This invention relates to a method and device for preventing corrosion in the cylinders of an internal combustion engine.

2. Relevant Art and Information Disclosure

As shown in FIG. 5, the general construction of an internal combustion engine 24 that is used for trucks, buses etc. includes a plurality of engine cylinders 10 (combustion chambers) fitted into cavities formed in an engine block 12. The opening in the block through which each cylinder is inserted fits snuggly around the cylinder and a space is left between the surface of the cavity and the external wall of the cylinder. Water is pumped through this space in order to cool the cylinder wall.

There are many designs of engine blocks having various cooling passages intended to provide greater efficiency in cooling the cylinders.

For example:

U.S. Pat. No. 4,702,204 is for a water cooled engine having a passageway through the water cooling jacket through which the lubricating oil passes and is cooled thereby.

U.S. Pat. No. 4,759,316 is for an engine with a cooling system comprising head side and block side cooling jackets to provide a large cooling surface.

U.S. Pat. No. 4,889,079 to Takeda et al is for an engine having a cylinder head comprising a plurality of partitions and plugs between cylinder heads to provide a passageway for cooling liquids.

U.S. Pat. No. 4,930,470 to Kabat is for a composite engine block comprising a bipartite liner structure forming a fluid cooling jacket in combination with a skin structure composed of lightweight damping material.

The market has shown no preference for any of these constructions over a simple design shown in cross section in FIG. 1. which includes a row of engine cylinders 10 positioned in a cavity 14 of an engine block 12. This sectional view is taken looking parallel to the axis of the cylinders and looking at the bottom of the cylinders. The plane of the sectional view is close to the bottom of the cylinders so that entry ports 16 are shown where cooling water may enter and circulate in the space 18 between the outer cylinder wall and the wall of the cavity. The direction of the currents of cooling water is indicated by the arrows. The cooling water passes out through a pair of exit slots (not shown) positioned diametrically opposed to one another at the top of the engine block at locations indicated by "A".

The engines having this design are sold by the Cummings Corp and are popular because of its simplicity and economy of construction.

The term, "standard" engine will be used in this specification to designate any engine having a construction similar to that shown in FIG. 1 and having an engine block with cavities in which are located cylinders and a space for cooling water between the inner cavity wall and the outer cylinder wall and, further, which has at least a pair of entrances at the bottom end of the cavity and at least one exit at the top end of the cavity.

The life of internal combustion engines is limited by corrosion of the cylinders with use so that, periodically, the engine must be "overhauled", i.e., have its cylinders replaced. The cylinders are generally degraded by the corrosive action of the water on the exterior walls of the cylinders. Overhaul is a major undertaking involving removal of the engine from the vehicle, extraction of the degraded cylinders, valves, etc. and insertion of new cylinders.

THE INVENTION

Objects

It is an object of this invention to provide an engine block characterized by simple construction and a longer life between overhauls than is experienced with engine blocks of the prior art.

It is another object of this invention to provide a method and device for greatly extending the life of already existing engine blocks between overhauls.

It is another object to reduce the rate of corrosion of the cylinders in engine blocks.

These and other objects will become apparent to the reader after reading the description and studying the drawings.

SUMMARY

This invention is directed toward a device inserted into the water cooling region between the interior cavity wall of an engine block and the outer cylinder wall which greatly reduces the rate of corrosion of the cylinder thereby extending the life of the engine between overhauls.

In one embodiment, the device is a metal strip, bent substantially to a U-shape, anchored to the edge of each entrance such that the ends of the U-strip extend into the cavity adjacent to the cylinder wall and in which the ends of the strip are configured to divert the stream of circulating water such as to prevent formation of velocity and pressure gradients in the stream that cause excessive corrosion of the cylinder.

DRAWINGS

FIG. 1 shows a sectional view looking down on the cylinders in the engine block of a standard engine (prior art).

FIG. 2 shows the pattern of corrosion that takes place on the outer surface of a cylinder taken from a standard engine.

FIG. 3A and 3B show the U shaped diverters which modify current flow according to the invention.

FIG. 4 shows the U shaped divertesr of FIG. 3A and 3B inserted, legs first into the entry to the cooling cavity of the standard engine block to modify water flow patterns.

FIG. 5 is a top view of an engine block (head removed showing the tops of the engine cylinders.

DESCRIPTION OF A PREFERRED EMBODIMENT

The following detailed description illustrates the invention by way of example and not by way of limitation of the priciples of the invention. This description will clearly enable one skilled in the art to make and use the invention and includes an embodiment which I believe is the best mode of carrying out the invention.

The invention is based on a study by the inventor during the course of many overhauls of standard engines and other engine designs. It was noted that areas of excessive corrosion formed a characteristic pattern on the exterior walls of each cylinder. This pattern was invariably located in a position related to the location of the water inlets and outlets and is illustrated in FIG. 2. (prior art). There is shown the pattern of corrosion 20 that has been formed in the exterior wall of the cylinder 10 which extends from the bottom edge to the top edge of the engine cylinder and extends annularly around a portion of the cylinder centered under the exit port at the top edge A which is located midway between the entrances but at the top end of the cavity.

Although I do not wish to be bound by theory, it is believed that, in the absence of the diverters of this invention which would otherwise divert the flow of water, water enters through each entrance 16 and divides into two streams, one going clockwise and the other going counter clockwise around the cylinder as shown by the arrows in FIG. 1. Corrosion occurs where the streams meet and thereafter flow to the exit port at the top of the cylinder. The condition is illustrated in FIG. 1 which shows arrows indicating the flow of water from each entrance 16 splitting and flowing circumferentially in opposite directions around the cylinder. The streams meet at two locations (A) midway between the entrances 16 and then flow vertically to the exit ports (not shown) at the top of the cylinder. This location of vertical flow is also the region where excessive corrosion of the cylinder wall takes place (under A in FIG. 1). It is believed that the excessive corrosion is due to increased concentration of air bubbles that accumulate because of pressure and velocity gradient conditions and that a difference in concentration of air bubbles between adjacent regions can produce differences in electrical potential resulting in corrosion by electrolysis.

Diverters, which are an embodiment of this invention, are inserted into the water passageway between the cylinder and cavity wall and prevent formation of these regions of excessive corrosion by disrupting the water flow pattern shown in FIG. 1. Two diverters, adapted to the "standard" engine design, are shown in the perspective views, FIG. 3 A and 3B. Each diverter, 22*a* or 22*b*, is seen to be substantially a strip bent into a substantially U-shaped configuration.

As shown in FIG. 4, the diverter 22*a* or *b* is partially inserted, legs first, into the entrance of the cooling region 18 by squeezing the legs together, then allowing the legs to spring back so that the edge of the slotted entrance 16 engages a detente 23, on the edge of the diverter. The diverter is thereby locked in the entrance 16 where it diverts the flow of cooling water around the engine cylinder so that the water current pattern is everywhere substantially continuously circumferential as shown by the arrows in FIG. 4. "Substantially continuously circumferential" is meant to mean that in all parts of the cooling area and particularly close to the cylinder wall, the water flows entirely in one direction, clockwise or counter clockwise depending on the orientation of the diverters.

In order to provide counter clockwise flow as shown in FIG. 4, the diverter 22 B (shown in FIG. 3B) is located on the right side of the cylinder 10. As shown in FIG. 3B. a flap 20 is located on one side of the "U" near one end. A detente 22 is also located on one side. Diverter 22A, located on the left side of the cylinders shown in FIG. 4, does not have flaps 20.

As indicated by the arrows in FIG. 4 with a diverter 22 located in each entrance 16 to the cavity 14, water entering the cavity through either entry is diverted by the ends of the respective diverter to flow in substantially one circumferential direction with the result that there are no substantial velocity or pressure gradients of flow where bubbles of air would accumulate to generate corrosive electrolysis. The presence of these diverters 22A and B in the entrances 16 has thereby resulted in a very substantial reduction in rate of corrosion and increased life between engine overhauls.

The material selected for making the diverter 22 a or b in the foregoing embodiment is low carbon steel. This selection is made on the basis of the matching the diverter with the cylinder wall to minimize any electrolysis that might occur if the materials of the diverter and cylinder are different. Furthermore, low carbon steel has a resiliency that meets the requirement for a spring-like material in view of the method for attaching the diverter to the edge of the cavity. However it will be understood that other materials may be selected such as a nonmetal or a plated metal which may be better than lowcarbon steel depending on the application.

In the foregoing paragraphs, a device and method of using the device has been described which meets the objects of this invention, namely, to substantially reduce corrosion of the cylinders in internal combustion engines. The embodiment described is adapted to a "standard" engine in which the water cooling passage is a cavity in the block surrounding the cylinder through which water passes from two slotted entrances at the bottom end of the cavity to an exit at the top end. The invention is based on the principle of preventing excessive velocity and pressure gradients in the stream of water surrounding an engine cylinder by insertion of diverters. Application of this principle such as selection of an appropriate shape of the diverter obviously depends on a variety of factors such as shape of the cavity, location and shape of the entrances and exits, etc. Variations in the method and device of this invention such as modification of the shape or location of the diverter depemnding on the engine design may become apparent which are embodiments of this invention. For example, the diverter may be made of a material other than steel. Furthermore, an application of this principle need not be limited to the prevention of corrosion in engine cylinders but may be applied to other situations where corrosion results from electrolysis produced by velocity gradients. In view of the above, I wish my invention to be defined by the scope of the appended claims and in view of the specification if need be.

I claim:

1. A device for reducing corrosion of an engine cylinder installed in the cavity of a water cooled internal combustion engine block wherein water currents flow from at least one entrance in a wall of said cavity to at least one exit in said wall through a space between said wall of said cavity and an outer wall of said cylinder in a pattern that produces corrosion on said outer cylinder wall, said device comprising:

a plurality of diverter means, each diverter means located in a position adjacent to one of each said entrance and constructed in operable combination with said walls of said cavity and cylinder for modifying said corrosive pattern of current flow to produce a pattern of current flow producing substantially less corrosion.

means for securing each said diverter means in said position adjacent to each said entrance.

2. A device as in claim 1 wherein:

said securing means is a strip section bent to a U shape with two legs and having an edge with a detent and one of said legs having one end connected to said diverter means providing that said securing means may be secured in an entrance to said cavity by engaging said detent with an edge of said entrance with said diverter means protruding into said cavity.

3. A device as in claim 1 wherein said diverter means is a strip section having an edge connected to said securing means and said strip section is configured in operable combination with said cavity wall and said cylinder wall to divert said water current to a circumferential pattern of flow around said cylinder.

4. A device as in claim 1 wherein said diverter means comprises a steel strip.

5. A device as in claim 1 wherein said at least one entrance is a pair of entrances, each entrance located in said engine block cavity wall at a bottom end of said engine cylinder in a position distal from said position of said other entrance and said at least one exit is located in a position on said engine block cavity wall at a top end of said engine cylinder and said diverter means comprises a strip configured in operable combination with said securing means, said cylinder wall and said cavity wall to provide a pattern of current flow that is substantially continuously circumferential around said cylinder thereby substantially reducing corrosion of said cylinder.

6. A method for substantially reducing corrosion of an engine cylinder pressed into a cavity of an internal combustion engine providing a space between a wall of said cavity and an outer wall of said cylinder with at least one entrance in said cavity wall where water may enter to form a pattern of current of cooling water, which current pattern produces corrosion of said cylinder, said method including the step:

securing a diverting means having a securing means adjacent to each said entrance in said space which diverting means, in operable combination with said cavity and cylinder walls, modifies said current pattern to a pattern of current selected to provide that corrosion of said cylinder is substantially reduced.

7. A method as in claim 6, wherein said diverting means comprises:

a strip having a first end attached to said securing means and an end section distal from said first end configured in operable combination with said cavity wall and said cylinder wall to modify said current to substantially reduce corrosion.

8. A method as in claim 7 wherein said diverting means comprises a steel strip.

9. A method for substantially reducing corrosion of an engine cylinder pressed into a cavity of an internal combustion engine providing a space between a wall of said cavity and an outer wall of said cylinder where water passes through at least one entrance through said cavity wall into said space where it forms a current of cooling water circulating partially in a clockwise direction and partially in a counterclockwise direction around said cylinder, which method includes the step:

securing a diverting means adjacent to each said entrance in said cavity which modifies said current to flow substantially in one circumferential direction.

10. An internal combustion engine including:

an engine block with a plurality of cavities;

a plurality of engine cylinders, an engine cylinder pressed into each cavity to provide a space between an outer wall of each said cylinder and a wall of its respective cavity;

each said cavity having at least one entrance through said cavity wall to permit water to enter and circulate in a current pattern in said space;

at least one diverter means, one of each said diverter means secured adjacent to one of each said entrances constructed in operable combination with said cavity wall for circulating said water in a substantially continuous circumferential direction of current flow around each said cylinder thereby providing a pattern of water current that substantially minimizes corrosion.

11. An engine as in claim 10 wherein each said diverter means comprises:

a strip configured in operable combination with said wall of said cavity and wall of said respective cylinder to direct said current of water in said circumferential pattern.

* * * * *